US006390940B1

(12) United States Patent
Naulls et al.

(10) Patent No.: US 6,390,940 B1
(45) Date of Patent: May 21, 2002

(54) BASKETBALL GAME, APPARATUS AND METHOD OF PLAY

(76) Inventors: William Naulls, 31096 Flying Cloud Dr., Laguna Niguel, CA (US) 92677-2714; Mark Armstrong, 3145 W. 43rd Pl., Los Angeles, CA (US) 90008

( * ) Notice: Subject to any disclaimer, the term of this patent is extended or adjusted under 35 U.S.C. 154(b) by 0 days.

(21) Appl. No.: 09/452,364

(22) Filed: Nov. 30, 1999

Related U.S. Application Data

(60) Provisional application No. 60/110,499, filed on Dec. 1, 1998.

(51) Int. Cl.[7] ..... A63B 71/00
(52) U.S. Cl. ..... 473/472; 473/490
(58) Field of Search ..... 473/472, 490

(56) References Cited

U.S. PATENT DOCUMENTS 4,171,808 A * 10/1979 Bauer
4,482,157 A * 11/1984 McNeil
5,810,679 A * 9/1998 Yoakum
5,882,271 A * 3/1999 Byrd

* cited by examiner

*Primary Examiner*—William M. Pierce
(74) *Attorney, Agent, or Firm*—Fulbright & Jaworski

(57) ABSTRACT

An alternative to traditional basketball that enables the audience to enjoy faster action than provided by traditional basketball, and which challenges especially gifted players with a more demanding and rigorous game. The game court is nearly twice as large as a traditional NBA playing court and the hoop is smaller and higher than a standard hoop and is played without a backboard. New rules are provided playing and for scoring wherein there are three point areas under and away from the hoop. The number, positions of the players, and mode of play are different, including the use of a protected goalie with the freedom to move without dribbling the ball, a running substitution box, and rules wherein the location of the ball, not the player, determines if play is live or dead.

24 Claims, 5 Drawing Sheets

BASKETBALL GAME, APPARATUS AND METHOD OF PLAY

CROSS REFERENCE TO RELATED APPLICATIONS

This application claims the benefit of Provisional Patent Application No. 60/110,499, filed Dec. 1, 1998.

BACKGROUND OF THE INVENTION

The invention relates to an apparatus and method for playing a game, more particularly, to a new game incorporating many aspects of traditional basketball.

Traditional basketball is a favorite spectator sport that has remained essentially unchanged for many years. The basic requirement for the sport is a rectangular shaped playing field between goals, a ball, and a certain number of players. The goals are hoops, circular rings elevated from the base of the playing field. It is the object of the offensive team to shoot and score by moving the ball through the offensive goal (the defender's hoop). Conversely, it is the object of the defensive team to disrupt and stop the movement of the ball through the offensive goal.

Spectators enjoy fast paced basketball such as when a team executes a fast break. However, the present rules and court configuration allow for a slower pace. There is nothing inherent in the rules or court configuration that encourages a fast paced game. Moreover, traditional basketball is generally played with preset formations that enable teams to score using well-rehearsed routines, which does not encourage fast thinking and on the spot innovations. The advantages of size also favors position over performance, endurance and stamina. It would be desirable, therefore, to have a faster, more challenging game that tests both the physical and mental stamina of basketball players.

SUMMARY OF THE INVENTION

It is the primary aim of the present invention to provide an alternative to traditional basketball that requires clear and precise decisions exposing both the fundamental and creative aspects of an athlete's repertoire. The present invention provides a competitive game where mistakes are capitalized on quickly, and wherein the rules of play encourage high-speed transitions, quick and explosive shot attempts, and limited game stoppage and disruptions. It is a team sport that is fast-moving and that provides enhanced opportunities for players to handle, distribute, and shoot the ball. The game enables the audience to enjoy faster action than provided by traditional basketball, providing for spectacular offensive maneuvers with the ball, increased offensive opportunities for players, and increased overall pace of the game. It challenges especially gifted players with a more demanding and rigorous game.

The subject game is played on a plastic, rubber or wood playing surface. A typical subject game court is approximately 114 feet in length by 80 feet in width (9,120 sq. ft.). This is nearly twice as large as a traditional NBA playing court which is 94 feet by 50 feet (4,700 sq. ft.). This increased playing field allows players to take advantage of the defense, while simultaneously requiring the offense to set up much faster.

The subject game goal hoop is similar in shape to a standard basketball hoop but is also quite different. The hoop is elevated to more than 10 feet and 3 inches, preferably it is at 10 feet and 6 inches, as compared to the NBA regulation basketball hoop which is elevated to 10 feet above the court.

In addition, the hoop preferably does not contain a backboard and extends an additional 2 feet further from the end-line than a basketball hoop. In addition to the foregoing differences, the hoop opening is less than 17 inches, and preferably is 16 inches, in diameter, which is significantly smaller than the 18-inch diameter of the traditional basketball hoop. This decrease in diameter of the hoop and the absence of a backboard on the hoop elevates the level of difficulty. The absence of a backboard increases difficulty, but this difficulty is balanced by the increased accessibility of the hoop; even shot attempts taken from behind the hoop are now feasible.

The subject game also offers new rules for scoring. Traditional basketball contains areas whereby a successful shot attempt is either worth two points when it is attempted close to the hoop, or three point shots when it is attempted far from the hoop. The subject game offers two areas on the court where shot attempts are worth three points, one inside a 3-point area and the other outside a circular 3-point shooting line. The area between the 3-point area and the 3-point line is referred to as the 2-point lane. The new rules are designed to provide incentives for players to advance the ball aggressively to the hoop, and/or to increase their outside shot attempts. Again, these distinguish exceptional players and challenge their athleticism more than traditional basketball.

Traditional basketball has five players (one center, two guards and two forwards) whom all have unrestricted movements on the court. In contrast, the subject game has six players and each player has a restricted area of play. For example, the "goalie" is a position created in the likeness and image of the NBA's center or "big man." He is restricted to areas close to his team's defensive, and has liberties which are not legal in traditional basketball, including deflecting shot attempts from the hoop inside the 3-point area on their downward arc, the freedom to move without dribbling the ball, and protected movement inside the 3-point area being completely protected. This latter aspect of the game is more similar to that of soccer, whereby the goalie is protected within in the goalie box.

The remaining five players, on both offense and defense, have restrictions on their areas of play and their shot attempts. The "runner" and "gunner" are restricted to outside the 3-point shooting line and both are limited to taking shot attempts from that range. Both players are good ball handlers and primary or good jump shooters. The "wingman" and "rim-man" are restricted to inside the 3-point shooting line (shooting from either the 2-point lane or the 3-point area), and both are limited to taking shot attempts from within that range. Both players are good ball handlers and shooter, although the rim-man is also a good rebounder. Lastly, the "slasher" has unrestricted movements, and can play and take shots from anywhere on the court. He is the most versatile player in the subject game.

The subject game consists of three 15 minute periods (45 minutes of total play) and uses a 17-second-shot clock, compared to the NBA quarters, each 12 minutes long, and its 24-second-shot clock. In the subject game the shot clock time is reduced to allow approximately 25% more shot attempts at the goal per game than professional basketball. This new rule translates to a faster paced, more exciting, brand of basketball.

In the subject game, each goal line has an elevated hoop that extends over into the court. The area underneath and in proximity of the hoop is referred to as the 3-point area. Successful shot attempts inside this region are worth three points. Thus, the inclusion of the 3-point area in the subject game is to encourage players to aggressively play offense and take the ball to the goal because more points are awarded from scoring in this painted area.

Each period of the subject game begins with a "face-off." This is similar to hockey and not present in basketball. A court judge initiates the face-off by smashing the ball on the floor. Players attempt to gain possession of the ball, and then can optionally advance the ball themselves or tap the ball to a teammate. In contrast, players in traditional basketball are only able to tap the ball to a teammate.

The subject game also introduces the "running substitution box." These boxes are placed on the side of the court where team benches are located. In order for a substitution to occur the substitute player places himself inside the box. He can only replace another player on the court once his team gains possession of the ball and once the active player enters the box. Additionally, substitutions in the subject game are allowed only during live play. Thus, limiting the many arrests in game play such is the case with professional basketball. Again, this new form of substitution creates a fast and continuous flow of action in the game.

In the subject game, the location of the ball, not the player, determines if play is live or dead. For example, the ball is considered live and in-play if the player is completely outside of court boundaries, yet he maintains a dribble inside the court boundaries, or on the boundary line. In essence, the ball must bounce completely off the court to be considered out-of-bounds. All the same, defensive players must always have both feet inside court boundaries. This new rule creates exciting sideline action for spectators as players' scamper to keep balls in play.

Lastly, a key aspect of the subject game is that court judges are not required to touch the ball after violations are called. Rather, the offense can inbound the ball themselves. In fact, for most violations a court judge quickly communicates the violation to a score judge and then whistles the ball live again. Additionally, players are allowed three steps (instead of the conventional two in basketball) after they stop dribbling. Once again, the purpose of this new rule is to keep the game moving, to reduce game arrests, and to enable more creative offensive opportunities for players.

BRIEF DESCRIPTION OF THE DRAWING

The features of the invention are best understood by reference to the following description taken in conjunction with the accompanying drawings in which.

DETAILED DESCRIPTION OF THE PREFERRED EMBODIMENT

While the invention will be described in some detail with reference to a preferred embodiment, it is to be understood that these figures are not intended to limit the invention to details described. It is intended to cover all alternatives, modifications and equivalents which fall within the scope of the invention as defined by the appended claims.

Figure 1B:
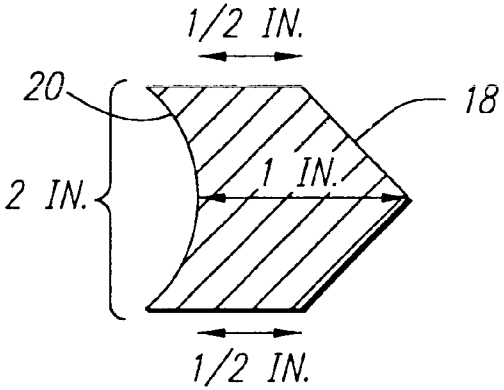
FIG. 1*b* is a transverse or cross-sectional view of the rim.
Figure 1A:
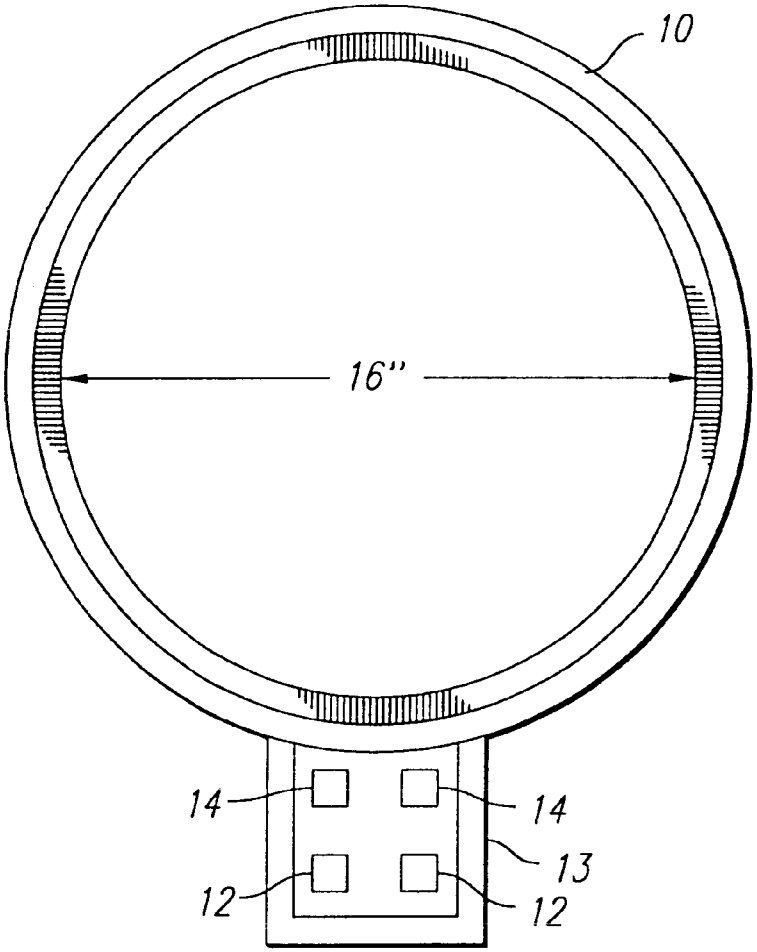
FIG. 1*a* is a top view the subject game hoop.

Turning to the drawings and referring first to FIG. 1, in reference to a subject game hoop 10 used in the subject game. The hoop 10 has a diameter of approximately 16 inches and circumscribed by a rim that is 1 inch by 2 inches, and is firmly attached to a part of the goal elevating system by pairs of front and rear uprights 12 and 14, respectively (see also FIGS. 3 and 4 which more clearly illustrate them) that extend from a counterweight floor box 16. FIG. 1*b* is a cross-section of the hoop 10 rim showing the rim to be centrally tapered at 18, approximately 1 inch in width and 2 inches thick at its thickest areas, which is about ½ inch in extent. The outer surface of the rim is non-smooth and the inner surface 20 is concave and smooth. The hoop 10 rim is preferably painted red.

Figure 2:
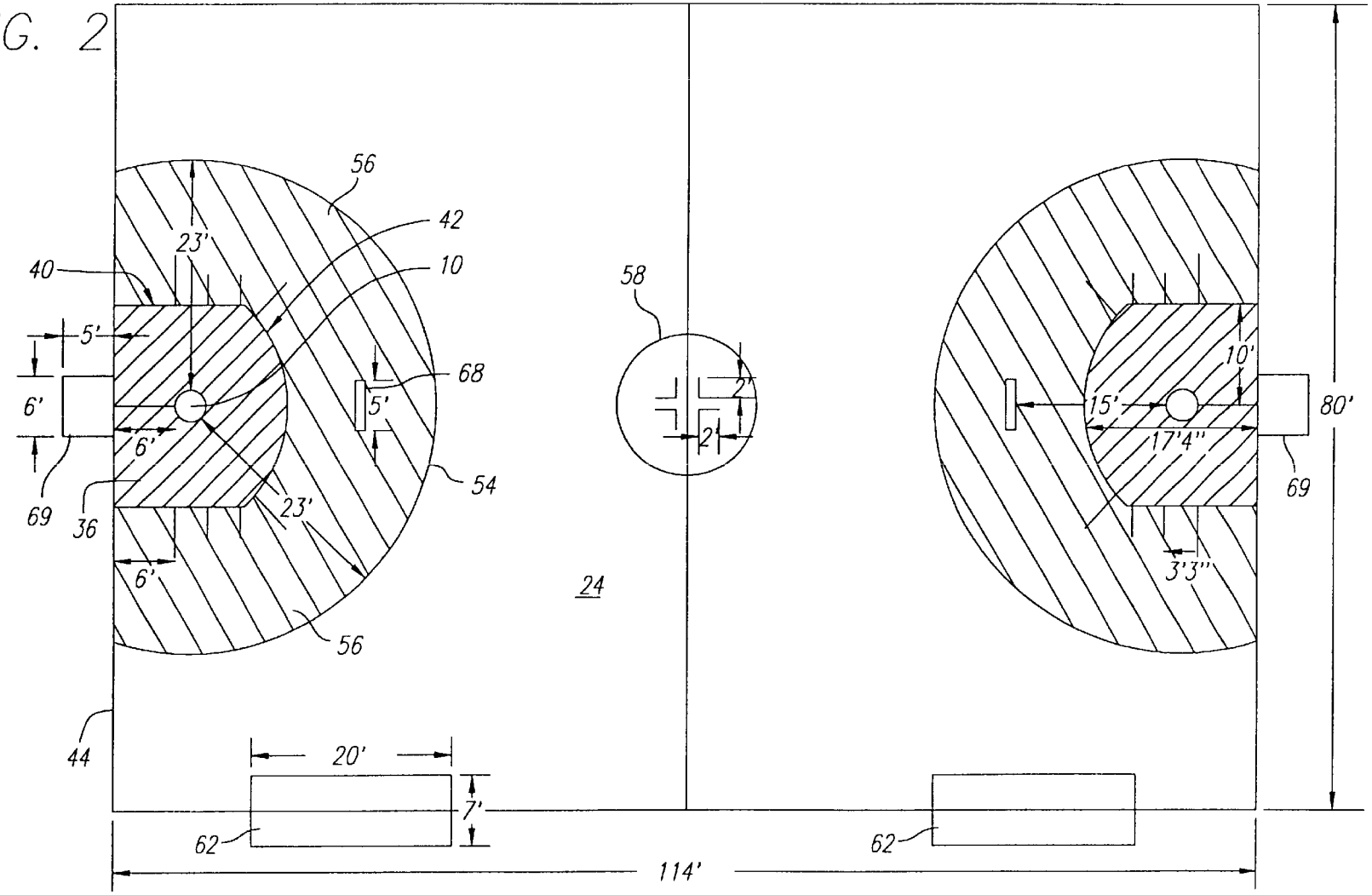
FIG. 2 is top view of the playing field, goals, and plurality of placement marking-lines of the game according to the invention.
Figure 3:
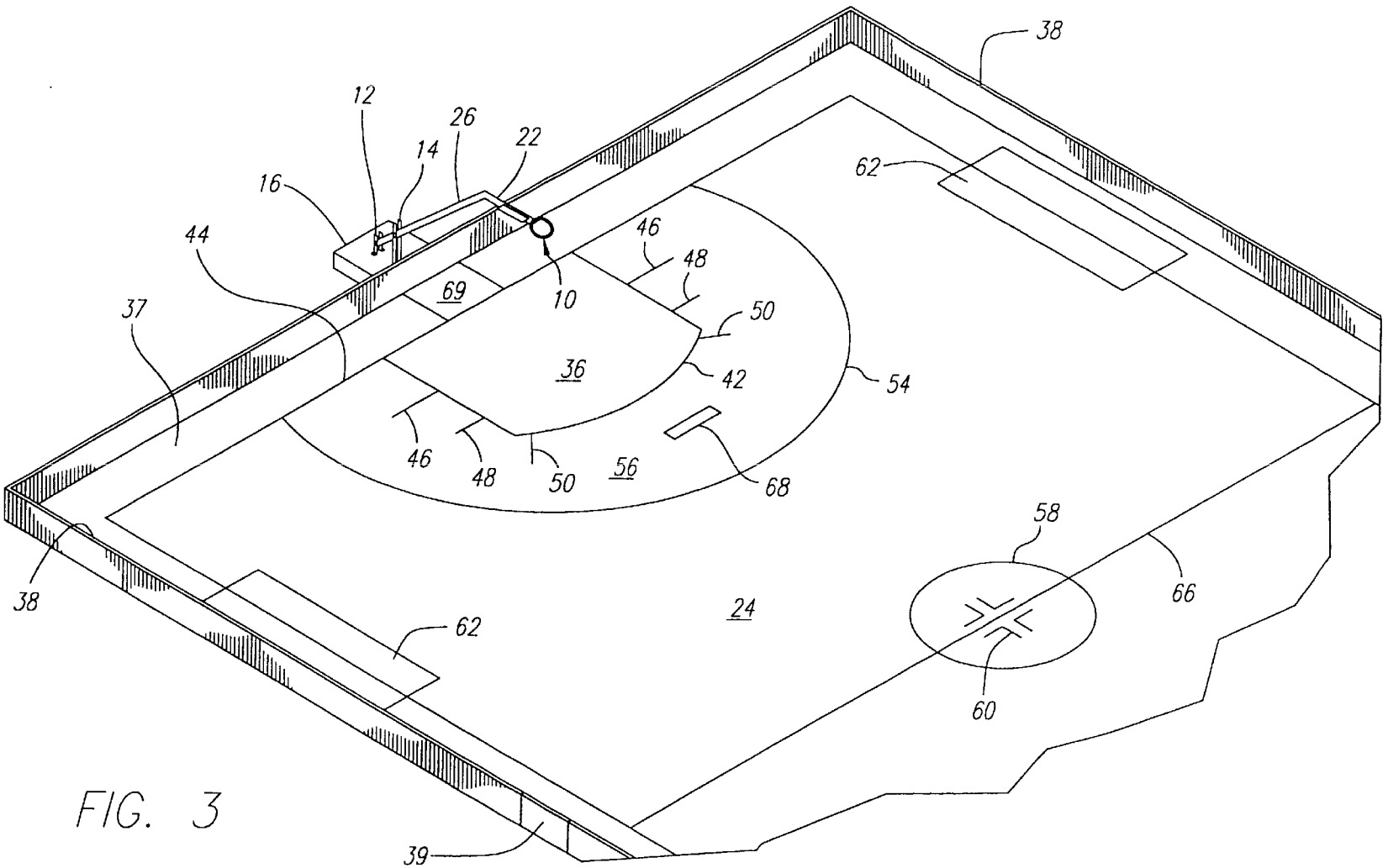
FIG. 3 is a perspective view of approximately one half of the playing field including the hoop, the goal elevating system, the 3-point area, the penalty shot line, and the running substitution box.
Figure 4:
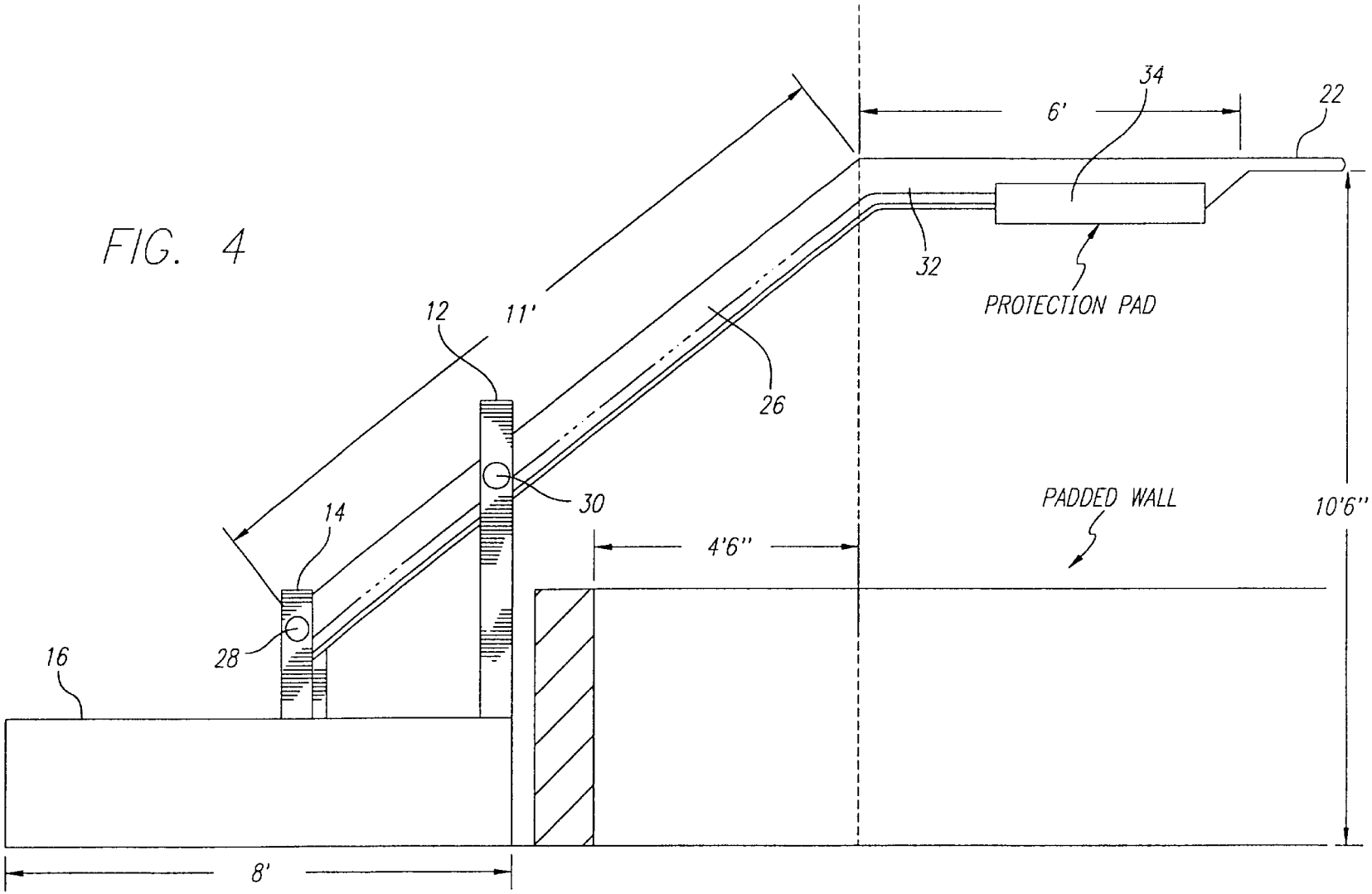
FIG. 4 is a plan view of the hoop and wall area.

Referring to FIGS. 2 and 3, as in traditional basketball, both opposing hoops (goals) 10 are attached to an elevating system 22 (FIG. 3). The interior back concave side of the hoop 10 extends approximately 6 feet from the back of the goal elevating system 22, which is firmly attached to floor and remains outside of the boundaries of the court 24. The goal elevating system 22 comprises a standard 26 secured between upright pairs 12 and 14 at a 45-degree angle by bolts 28 and 30 that extend through openings therefor respectively in the uprights 12 and 14 and spaced in the standard 26. The standard 26 terminates in a horizontal section 32 which, along its mid region, is protected by a padded sleeve 34. The horizontal standard section 32 terminates with the hoop 10, which can be welded or bolted to the terminal end of the horizontal standard section. There is no backboard, which requires the players to exercise substantially more skill than in traditional basketball. The goal elevating system 22 extends over the court 24 for approximately six feet and is demarcated to define a 3-point area. The hoop 10 is elevated approximately 10 feet and 6 inches above and parallel to the court 24. Each goal elevating system can contain an affixed shot clock (not shown) that does not interfere with the hoop 10.

The playing field 24 has a general rectangular shape and has a total length of approximately 114 feet and a total width of approximately 80 feet. The playing field or court 24 can be located inside a standard-sized arena and is circumscribed by a four foot out of bound section 37 which itself is circumscribed by a padded wall 38 separating the field from the surrounding spectator area. The padded wall 38 has a gate 39 centrally located on one side (the official's side) through which substitute players can enter the out of bound section 37 to go to a running substitution box, described infra. The playing field 24 is covered by plastic or materials similar to that found in other stadiums used for traditional basketball. A similar game with similar dimensions in length and width may be played in an indoor or outdoor facility.

In order to provide for accurate placement of players and ball, the playing field 24 is divided by a plurality of demarcated placement lines. First, the 3-point area 36, also called the key, is delimited by parallel lines 40 separated by approximately 20 feet, and extending from the end line approximately 11 feet. The remainder of the 3-point area is completed by an arc 42 which connects the two parallel lines 40 at their end-point 11 feet from the end-line 44. The greatest distance of the arc 42 from the end line 44 is centered approximately 17 feet 4 inches from the end line. In contrast to traditional basketball, whereby goals are worth two points when taken in close proximity to the goal, successful shot attempts inside the 3-point area 36 are worth three points.

Associated with the 3-point area 36 are a plurality of position lines that are located perpendicular to and on both sides of the 3-point area 36 delimiting lines, and which serve to locate players while a free shot is being taken. The first pair of position lines 46 on each side of the 3-point area 36 are parallel to and extend approximately 6 feet from the end line 44. The second pair of position lines 48 are approximately 3 feet from the first pair of position lines 46. The third pair of position lines 50 are approximately 3 feet from the second pair of position lines 48.

Second, in the subject game there is a 3-point shooting line 54 that is delimited at approximately 23 feet from the outside surface of the hoop 10 from all angles, giving the 54 a circular shape. Players on the court 24 are rewarded three points for successful goals taken inside the 3-point area 36 or outside the 3-point shooting line 54. Therefore, the only area of the court 24 that rewards two points for successful shot attempts is the area 56 between the 3-point area 36 and the 3-point line 54. This area is also called the 2-point lane, and is preferably painted with some contrasting color against the color of the playing field 24, which also serves to visually set out the 3-point area. A similar area in traditional basketball is the region most utilized by players. Ideally, the marking-lines incite players to be more aggressive to take shot attempts that reward 3-points versus those that reward two points.

Third the playing field 24 contains a face-off circle 58 approximately 14 feet in diameter that is placed in the center of the court 24. In the center of the face-off circle 58 there is a plurality of corners 60, each defined by lines that intersect at 90 degrees, each line being approximately 3 feet in length. The four corners 60 point to the center of the face-off circle 58. Activities in the face-off circle 58 mark the beginning of each period of the game. A face-off is similar to a jump ball in basketball, which is used to settle disputes regarding ball possession. Unlike traditional basketball, a face-off in the subject game also starts each 15 minute period with players from both teams scrambling for possession. Also unlike traditional basketball where jump ball players have to tap and pass the ball to a teammate once they gain possession of the ball, in the subject game players can either pass the ball to a teammate or move the ball themselves.

Finally, the subject game contains a running substitution box 62, each one marked off on each team's side of the court 24. The running substitution box 62 has a general rectangular shape with a length of approximately 20 feet and a width of approximately 7 feet. The substitution box 62 begins 32 feet from the end lines 64 and 66 defining the opposite sides of the court 24. One-half of the rectangular running substitution box 62 is placed outside of the boundaries of the playing field, 24. In the subject game, a substitute player in the substitution box 62 can only rejoin the game in process if his team has possession of the ball, and when an active player enters the same running substitution box 62. Additionally, substitution of players is allowed only during live game play and not during stoppage of the game. This prevents the substitute and active players from being on the court simultaneously, slowing down the pace of the game.

Players

The subject game involves at least six players on both offense and defense. It is preferable that six players from each team make up the team roster, however, a minimum of three players from each team can play a similar alternative game. Unlike traditional basketball, each player in the subject game has a restricted area of play. The most important position in the subject game is the goalie. He plays within the 3-point line 54 on his team's defensive goal. He has increased liberties inside the 3-point area 36, except in "power play" situations. Liberties of goalies include defending his team's defensive goal, even to the extent of deflecting a shot attempt from inside the 3-point area 36 on its downward arc. However, shot attempts outside the 3-point area 36 are not legal for the goalie to deflect. A power play situation occurs when a team is charged with a goalie restriction (refer to Game Definitions). The penalty team has its goalie removed from game play, and the opposing team's goalie then has unrestricted movement. Because the goalie has greater freedom than any other player, there is increased incentive for other players to take more shot attempts from outside the 3-point area 36, which the goalie cannot defend.

Additionally, there are two rules that make the goalie a decisive player on the team. First, he is protected inside the 3-point area 36, meaning he is not guarded by a defensive player. A similar situation occurs in soccer, where the goalie is protected inside the goalie box. Second, he can move the ball inside the 3-point area 36 without dribbling the ball. Both rules make the goalie a weapon for the offense and a rival for the defense. Moreover, the goalie does not have to take the ball out when the opponent scores.

The remainder of the team consists of five players. Two of the players, the "runner" and the "gunner", have similar plays and restrictions. They both play and take shot attempts from outside the 3-point shooting line on both offense and defense. Still two other players, the "rim-man" and the "wingman", have similar plays and restrictions. Both play and take shots from inside the 3-point shooting line on both offense and defense. The rim-man and wingman can also handle the ball in Transition Plays, but shot attempt restrictions remain the same.

The slasher is the most versatile player on both offense and defense. He has no restrictions of motion and can take shot attempts from all areas of the playing field including the 3-point area 36.

Teams

A team shall consist of 14 players, and cannot be reduced to fewer than six players. When more players are disqualified then remain eligible to play, the last player to be disqualified remains in the game. A team is then penalized with a goalie restriction in addition to a "clip" being charged (see "Clips and Violations"). In fact, any clip charged to a disqualified player penalizes that team with a goalie restriction. This rule also applies to players remaining in play with seven or more clips. If during a game there exists only six eligible players, and one of these players become injured or are ejected, then the last player disqualified, before the injured or ejected player, is placed back in the game.

Team Roster

Each team submits the names and numbers of their team to the score judge 10 minutes prior to the first period face-off. The roster will list players who are to start the game; failure to comply will result in a goalie restriction, or eight possessions for the opposing team.

The Captain

The coach appoints a captain or co-captain. Any player suited in a uniform and on the roster can be appointed captain, except a player who doubles as a coach. Captains can speak to the court judges only during time-outs called by the judges. The captain remains active throughout the game, unless due to game injury or ejection. If an injury or ejection occurs, coaches immediately appoint a new captain. Again, the player change is notified to the head judge by the head coach.

The Coaches

All coaches are required to keep within 10 feet of their team's bench; all movements greater than 10 feet beyond the bench are by permission only from a court judge. Moreover, coaches can approach and speak to court judges and the score judge only during official time-outs, between periods and/or intermissions. All other members of the team must remain on the bench.

Substitution of Players

In the subject game, rules regarding substitution of players are significantly different from what they are in basketball. First, a substitute player reports to the score judge and gives his name and number, as well as the name and number of the player he will replace. He then proceeds to his team's running substitution box 62. Once his team gains possession of the ball, the active player must enter the same running substitution box 62 in order for the substitution to take place. The replacement is now eligible to play. Substitution of game players can only take place during live play; and not during game time-outs called by the court judges, technical fouls, dead balls, or free shot attempts. Again, any exchange or replacement of players must occur via the running substitution box 62 and during team possession; or less than 17 seconds on the shot clock, whichever runs out first. Violation of this rule will result in a team clip, and the opposing team is awarded three free shots and a goalie restriction. Also, recall of replacement players will occur if the active player is not completely in the running substitution box 62 when the substitution takes place.

Costumes

Each team will dress in matching apparel with numbers identifying each player, except for slashers who may dress in different costumes. All costumes will be approved by a designated governing organization. The player's number is placed on both shirts and shorts, and numbers are large enough to be easily visible from long distances. In any variation of the game, it is preferable that the home team wears dark suits and visiting teams wear light suits.

Selecting Goals

The home team chooses the goal for the first and third periods, while the visiting team selects the goal for the second and any overtime periods.

Judges

The number of judges in the subject game is six, however, two of the six are a score judge and a time judge. There are four court judges, one of which is the head judge.

It is the responsibility of the judges to check that all game and player equipment meet the subject game specifications. He also must be present as teams prepare for the game, and meet with team captains five minutes before the first period of the game. Most important, judges have the authority to determine issues not specifically discussed in the "rules and regulations" of the game. In all situations, the head judge has sole authority to question decisions regarding rule interpretations made by any of the other three court judges. For example, if a penalty occurs during a successful shot attempt, the mid-court judge then has to determine if the basket is awarded. In the event of uncertainty, all judges will meet with the head judge to determine the call. If disagreement continues between the court judges, the opposing teams will determine possession by a face-off.

When penalties occur, judges blow their whistles and extend an arm upwards indicating a halt in the game. This also is a signal to the time and shot clock judges to stop their respective timers. If a judge extends an arm outward, 90 degrees from the vertical axis, this signifies the ball is immediately live. Similarly, if a ball is knocked off the court and out of play, the whistle is blown and an arm extends outward in the direction of the team with possession of the ball. In either situation, this outward hand motion signifies the ball is in play. In the subject game, court judges do not need to touch the ball, they simply explain the penalty, indicate the player(s) involved, and what action needs to be taken to the score judge. This rule increases the speed of the game.

Additionally, judges reserve the right to stop play at any time to address any unusual game occurrences, or correct mistakes when rules are overlooked. Examples of overlooked mistakes include but are not limited to: 1) a team not receiving a penalty shot attempt; 2) a team receiving an unearned penalty shot; and 3) the wrong player attempting a penalty shot. It is crucial that all mistakes are addressed in the same period in which they occurred. Ideally, once the score judge becomes aware of the mistake, it should be corrected during the first dead ball. If a mistake is detected before the 17-second-shot clock expires, the 17-second clock is reset and the game clock resets to the time of the violation. In another situation, when a team begins the game by attempting to score at the wrong goal, if more that 17-seconds has elapsed, the mistake is nullified and play continues unchanged. However, if less than 17-seconds has elapsed, the mistake is corrected and the game clock is restarted. On the other hand, in all cases, any errors made by the score judge must be addressed before the end of the game.

The Head Judge

The head judge is in charge of all judges including the remaining three court judges, the score, time and shot clock judges. Head judge responsibilities include: 1) discussing rules of an event with both team coaches; 2) putting the ball into play during the opening face-off; 3) designating a court judge who then conducts the face-offs for the remainder of the game; and 4) meeting with the other court judges to determine a call if there is disagreement.

The Score Judge

A score judge's responsibilities include: 1) keeping records of both successful and failed penalty and non-penalty shot attempts; 2) maintaining a running log of all successful scores, individual and team clips, participants for both teams, player substitutions, and each team's "double defense violations." In most cases, the score judge notifies the head judge, who then notifies the head coaches, especially when a player receives seven or more clips. Teams are allowed four team clips per 15 minute period; more than four places the team in "penalty." In a special instance, the score judge notifies the head judge when a team exceeds two violations. He then notifies the time and/or court judges by using a buzzer. The same buzzer is also used to stop play, award free shots, correct game play errors, or when players exceed seven clips.

The Time Judge

Time judges are primarily responsible for keeping accurate time in the game. The game clock begins once the ball is smashed at the face-off. During throw-ins, game and shot clocks start once a player on the court touches the ball. During free shot attempts, the game clock starts once a player rebounding touches the ball. Game time continues to run even when a court judge indicates a change of possession, yet does not stop game play. The time judge is also responsible for notifying court judges and head coaches of important time indicators such as: 1) seven minutes before the game; 2) two minutes prior to the start of each period; and 3) the expiration of a game period, or the game clock reaches 0.00. In all situations, he uses the buzzer to signal time indicators. In the event of buzzer failure, the time judge notifies court judges by any means available.

Scoring

A legal shot attempt or free shot occurs when the ball enters the hoop 10 from above and falls through the bottom. If both feet are completely within the 3-point area 36 and the player makes contact with the floor before the goal attempt begins, this successful shot attempt is worth three points. However, successful shot attempts with only one foot within 3-point area 36, or feet partially in the key, count as two points. A successful shot attempt with both feet on the floor outside the 3-point shooting line 54 before the goal attempt counts as three points. Upon release of the ball, the shooter may contact the 3-point shooting line, or land in the 2-point lane. All other successful shot attempts with both feet on or inside the 3-point shooting line counts as two points. All successful free shots count as one point.

Any points scored, no matter who scores the points, is given to the team shooting at that goal during that period. If the ball is tapped into the goal without a player gaining possession and returning to the floor with the ball, then the goal is scored from where it originated. Points are rewarded to the person who tapped it in. On any goal scored from a pass, with the shooter catching and shooting the ball in mid-air, the number of points awarded is determined from the origin of the pass. Finally, the running score is the official score, even in the event of unresolved scoring disputes.

After a successful shot attempt, the goalie is the only player on the court who can put the ball back in play without taking the ball out. If the goalie is in the penalty box, then any player may throw-in the ball, and all throw-in rules apply.

Clip and Violations

A "clip" is an illegal contact with an opponent during play, while a "violation" is a breach of rules governing the progression of the game. Game clips include: 1) a player behavior penalty given to players both on and off the court for inappropriate behavior during a game; 2) a player behavior penalty for unnecessary and excessive contact against an opponent; 3) a "double-clip" for when two opponents commit penalties or violations against each other during the same play; 4) an "offensive clip" for illegal contacts initiated by an offensive player during play; 5) a "defensive clip" for illegal contacts initiated by a defensive player during play; and 6) a "no possession clip" for illegal contact during play while neither team has possession of the ball.

The following are considered violations in the subject game: 1) being inside the 3-point area 36 for more than 2 seconds; 2) the ball entering the hoop 10 from underneath it; 3) an illegal assist in scoring (as described infra); 4) a free shot violation by the offensive team; 5) the ball out of bounds; 6) offensive goal blocking; 7) a penalty not resulting in a penalty shot; 8) defensive goal blocking; 9) roaming (refer to Game Definitions); 10) double dribble; 11) striking or kicking the ball; and 12) a 17 second shot-clock violation.

All clips and violations are penalized by the ball being awarded to the opposing team, and taken out of court boundaries in the proximity of the violation for a throw-in, or by a free shot attempt.

Time

A regulation game consists of three 15 minute periods. Three minutes are allowed between the first and second periods, and ten minutes between the second and third periods. All overtime periods because of a tie score are five minutes in length. The visiting team selects the goal in any overtime period(s), and the game resumes in two minutes. Unlike, traditional basketball, there are no time-outs. It is the ultimate responsibility of the time judge to start and restart the game clock, even in the event that the court judges forget to signal.

A period ends when time expires. However, the following exceptions are made: 1) if the ball is in flight, then the period ends when the goal is completed, missed, or touched by any player; and 2) after free shots following personal and/or technical clips, or violations which occur at when the game clock reads 0:00 yet the buzzer does not sound. If during the final seconds of the game, the ball is in flight during the final shot attempt and is then touched by a defensive player, it is considered good if the shot attempt is successful. On the other hand, if the ball is in flight during the final shot attempt and is then touched by another offensive player then the game is over. Also, time-out requests by court judges made at approximately the instant that game time expires for a period are not granted.

During game play, the court judge can halt the game clock when any of the following occurs: 1) a personnel clip or technical violation; 2) a face-off; 3) a court violation; 4) a delay or emergency; and 5) if the ball is off-court (refer to Rules and Regulations). The clock starts again under the live ball rules, infra. However, in the last one minute of the first and second periods, and in the last 2 minutes of the third period, the game time only restarts once the ball is advanced out of the 3-point area 36.

Conversely, the game clock starts when any of the following occurs: 1) a face-off and the court judge slams the ball; 2) after a violation and a court judge whistles a change of direction; and 3) the ball is placed at the disposal of a free shot shooter.

Time-outs

The teams have no time-outs. Court judges may call an official time-out for the following incidences: 1) discrepancy in a call made by a court judge; 2) injury to a player(s), coach(es), or court judge(es); 3) an emergency; 4) equipment failure; and 5) an intrusion onto the court by spectators, or foreign object(s).

Beginning Games and Periods

Each period begins with a face-off (refer to Rules and Regulations) at center court in the face-off circle 58. The face-off marks the beginning of each period and all overtime periods. A face-off situation results when any of the following occurs: 1) a double clip; 2) a double clip on a no possession clip; 3) a disagreement on a double clip violation; 4) a loose ball whistle blown by mistake; 5) a player double behavior violation during a loose ball; 6) a Tie Up; 7) a ball out of bounds caused by both teams; and 8) a judge is in disagreement on who caused the ball to go out of bounds. In all situations, a face-off is always between the two opponents involved in the situation. No substitute is allowed to participate in a face-off unless the involved player becomes injured.

Rules and Regulations

Face-Off

A face-off places one player from each team at the center court with an equal opportunity to secure possession of the ball. Each player is positioned behind a face-off corner 60 opposite his goal. The court judge positions himself between the players and smashes the ball down on the court floor, the ball then bounces vertically off the court and into the air. Once the ball is airborne, and above the players' heads, the players may either jump and tap the ball to a teammate, or optionally jump and grab the ball themselves to gain possession.

The following rules apply when players are involved in a face-off: 1) each must have both feet behind the lines of the respective face-off corner 60; 2) the ball must be touched by one of the face-off players before other players may take possession; 3) either face-off player may take possession of the ball; 4) the face-off player may advance the ball by dribbling; 5) players not participating in face-off must remain outside of the face-off circle 58 until the ball is touched; 6) players must wait until the ball is above their heads before they pursue possession; 7) the game clock starts when the ball is touched; and 8) the 17-second shot clock starts once a player has possession of the ball.

Throw-In

The ball is immediately available for throw-in once a court judge indicates a change of possession with a whistle, and extends an arm outward pointing in the direction of possession. The following rules apply for a throw-in: 1) the throw-in person may not step on or across the court line until the ball is released into the court; 2) the throw-in person can take three steps in any direction, but cannot step inside the court boundaries; 3) the throw-in person cannot change his direction once movement begins; 4) the throw-in person has three seconds to inbound the ball; 5) defensive players cannot extend any part of their body over the court boundaries; and 6) if the ball is not released within three seconds, the ball changes possession at the same location.

As an exception to the throw-in rule, after a successful goal from the opposing team, the goalie can pass the ball to a teammate without taking the ball off the court for a throw-in, or he can optionally forward the ball himself inside the 3-point area 36 without dribbling. On the other hand, all other team players must take the ball off the court for a throw-in, and the goalie is in the goalie restriction box 68.

Dead Ball

A ball becomes dead and/or remains dead when the following occurs: 1) tie-ups; 2) time expires for the end of any period; 3) personal clips; 4) free shot attempts; 5) roaming; 6) 2 seconds rule (refer to Game Definitions); 7) shot clock violations; 8) player behavior violation; and 9) a whistle blown by mistake.

Live Ball

A ball becomes live when the following occurs: 1) a participant of a face-off touches the ball; 2) the ball is released during a throw-in; and 3) the free-throw shooter releases the ball on the final attempt.

17-Second Shot Clock

The subject game uses a 17-second-shot clock. It starts when a team gains possession of the ball. On a throw-in, the shot clock starts when a player on the court gains possession of the ball. A team must make a shot attempt before the 17-second clock expires. In a legal shot attempt the ball must leave the player's hand and touch the hoop 10 before the expiration of the shot clock. Teams are considered to have possession when holding, passing, or dribbling the ball, even if the ball is deflected. Additionally, the game clock functions as a shot clock only if there is 17 seconds or less remaining in a period.

When there is loss of control of the ball, the ball is simply dead and the opponent gains possession. If a defensive player does not touch the ball or obtain control of the ball, the 17-second-shot-clock continues. If the ball is deflected by the goalie on its downward arc (legal goal blocking) and still manages to touch the hoop 10, it is considered a legal shot attempt and the 17-second-shot clock is reset. However, if a ball is deflected by the goalie on its downward arc and the ball does not manage to touch the hoop 10, the shot attempt is considered a block and the 17-second-shot clock continues.

The 17-second-shot clock is stopped if a violation occurs. If the offensive team maintains possession, they continue to have the time remaining to make a shot attempt. However, if the offensive team has possession when the shot clock reads 0.00, a 17-second violation has occurred; even if the buzzer has not sounded. Anytime the 17-second clock reads 0.00, time has expired and the ball is dead. Exceptions to this rule are if there is a defensive violation, or if personal clips or technical violations on the defense are made.

In a different instance, during a failed shot attempt, a face-off results if simultaneously a court judge blows a whistle by mistake and the 17-second shot clock buzzer sounds. Conversely, if the shot attempt is successful, then points are awarded for that goal and the whistle is ignored.

Off-Court

The ball is out of bounds when the ball touches a player, any object including the floor, and any portion of hoop 10 elevating system 22 that extends outside the boundaries of the court 24. Consequently, a player is then considered *"off-court" if he is holding the ball and together he and the ball touch the floor or any object outside the court boundaries.

Players may dribble the ball on the court boundary line, even if they are off court, and the ball remains live. In such situations, defensive players can only take defensive action from a position inside the court boundaries. The defensive player having both feet inside the court boundaries tries to defend the ball while keeping the offensive player from returning to the court.

Possession of the ball in an off-court situation is determined by the last person who touched the ball. That person can be in, on the line, or off the court. A face-off situation occurs if two opponents touched the ball at the same time and forces the ball to go off-court, or if disagreement by the court judges as to the last person to touch the ball. Once the ball is off-court, a court judge indicates a change of possession and the ball is immediately available for throw-in.

A ball continues to be live if a player dribbles entirely inside the court even though his entire body is outside of the court. If he should pick the ball up or pass it while still outside the court boundaries, he is charged with an off-court violation. However, an open hand slap pass off the dribble is not an off-court violation.

Also, the ball is considered live if a player gains possession of the ball while being airborne outside the court boundaries; even if he begins his dribble on court before his feet touch the floor. He must begin his jump inside the court before becoming airborne outside the court.

If players have any part of their bodies positioned outside the court boundaries, they must then gain possession of the ball through a dribble. Any other means of ball possession is considered an off-court violation.

Free Shot

When free shots are awarded, the shooter stands behind the free shot line 68 and the court judge gives him the ball. The players of each team have a special line up during all free shots: 1) the goalie is in a goalie restriction box 69 (see FIGS. 2 and 3); 2) teammates of the shooter are in the first baseline position spaces 46; 3) opponents of the shooter are in mid-key spaces 48; 4) one teammate and one opponent may occupy a high-key space 50; and 5) remaining players position themselves outside of the three-point shooting line 54. Similarly, runners and gunners who are not shooting free shots must position themselves in their normal areas of play.

Penalties and Vioaltions

Free Shots

The following are free shot rules: 1) the player has 5-seconds to attempt a free shot, and all attempts are from behind the free shot line 68; 2) no player may touch the ball until it contacts the goal rim or the colored section of the elevating system 22; 3) players around the 3-point area 36 during a free shot attempt cannot move into the key, or move away from the key; and 4) defensive players cannot distract the shooter until the ball is released by the shooter.

If the above free shot rules are violated during free shot attempts, the following penalties apply: a) if the offensive team violates any of the above free shot rules, no points are scored, and the defensive team receives the ball for a throw-in from the sideline; b) if the defensive team violates free shot rule 2 (touching the ball before it contacts the goal or elevating system) and the shooter misses the free shot attempt, then one point will be given to the shooter; c) if the defensive team violates free shot rule 3 (players moving into the 3-point area 36 during free shot attempts) and the shooter misses the free shot attempt, then another free shot attempt is given; d) if the defensive team violates free shot rule 4 (distracts the shooter) and the shooter misses the free shot attempt, then another free shot attempt will be given; and 5) if there are double violations committed by offensive and defensive teams when the ball is live, the ball is then considered dead and a face-off occurs.

Off Court

The goal of any player is to keep the ball live inside the court boundaries. The penalty for any off-court violation is loss of the ball, and the ball is awarded to the opponents.

Dribble

Players must move with the ball by a dribble (refer to Game Definitions). A player advancing the ball by dribbling may touch or cross the court boundary line with his body and still maintain dribble and possession. The ball cannot bounce completely out of the boundary, but may touch the boundary line. A player cannot restart his dribble once he stops dribbling. He can restart if he makes a shot attempt, and as long as the ball touches the goal rim or color section of goal elevating system. He can also restart dribbling if an opponent knocks the ball out of his hand, or causes him to fumble the ball and the ball touches the court. A player may not dribble with both hands.

The penalty for dribble violations is loss of the ball, and the ball is awarded to the opponents.

Throw-In

The following are considered violations by the thrower during a throw-in: 1) moving with the ball by carrying it inside the court boundaries; 2) failing to release the ball within three seconds; 3) shooting the ball prior to the ball being touched inside of the court boundaries; 4) stepping on the court line; 5) causing the ball to go off-court before being touched inside of the court boundaries; and 6) changing direction once the first step is taken. Once a team selects a thrower, this person cannot be changed.

The penalty for throw-in violations is loss of the ball, and the ball is awarded to the opponents.

Strike Ball

A player may not intentionally kick the ball or strike it with his fist. If the strike ball violation is by the offense, the ball is awarded to the opponent at the sideline nearest the location of the violation. If the violation is by the defense, the offensive team retains possession nearest the location of the violation. In both situations, the 17-seconds-shot clock is reset.

Face-off

If a personal clip is committed prior to either team obtaining possession of the ball during a face-off, it is ruled a no possession clip (refer to Game Definitions). Face-offs are also replayed if the court judge rules that the ball smash is bad.

The penalty for a face-off violation is loss of the ball, and the ball is awarded to the opponents. A double clip (refer to Game Definitions) violation will result in another face-off.

Two Seconds Rule

An offensive player cannot remain more than 2 seconds in the 3-point area 36. This is similar to the 3-second rule in NBA basketball, which prohibits players from having possession of the ball for greater than 3-seconds in the painted area underneath the goal. If the player begins to make a shot attempt, then the 2-seconds count is suspended until possession of the ball resumes after the shot. However, if the shooter does not continue through with the shot, the 2-seconds count resumes.

The penalty for violation of the 2 seconds rule is loss of the ball, and the ball is awarded to the opponents.

Ball Passing Through Bottom of Goal

A player cannot score by passing the ball vertically through the bottom of hoop 10. The penalty for this violation is loss of the ball, and the ball is awarded to the opponents on the sideline.

Leap Disadvantage

A player cannot use the hoop 10, or the hoop elevating system 22, to gain a height advantage. Similarly, a player cannot use another player to gain height or a jumping advantage. If the offensive team violates this rule, the ball is awarded to the opponents. If the defensive team violates this rule, a goalie restriction is awarded to the offensive team (2 possessions).

Roaming

A player who gains possession of the ball in a standing position, may rotate using either foot. On the other hand, a player who gains possession of the ball while moving, on the run, or dribbling, has three steps to make a shot attempt, or stop and select a swivel foot.

The three steps are counted by the following rules: 1) the first step is when the player takes his first step after dribbling is stopped or if the player's feet are on the floor when he gains possession of the ball, or if he is airborne when gaining possession of the ball, then the first step is when both feet touch the court floor simultaneously; 2) after the first step, the second step is when the player lifts either foot off the floor and then returns that same foot to the floor; and 3)after the second step, the third step is when the player lifts the foot not previously used in the second step and then returns that foot to the floor.

Additionally, players who stop on the first step, may take additional steps and use that foot as their swivel foot. If a player is on his second step, he may use his second foot as his swivel. If a player in possession of the ball raises his swivel foot on the third step, he must pass or shoot the ball before his swivel foot returns to the floor. Also, if the same player drops the ball, intentionally or unintentionally, he cannot be the first person to touch the ball. Similar to standard basketball, dribbling cannot resume unless the player releases the ball before lifting a swivel foot from the floor.

The penalty for roaming violations is loss of the ball, and the ball is awarded to the opponents.

Goal Blocking

A goal blocking violation is committed if a player touches the hoop 10 or the goal elevating system 22 when the ball is on or within the hoop 10. There are two exceptions to this rule: 1) if the offensive or defensive player has hands legally on the ball before contact with hoop 10; and 2) if the offensive player releases the ball within the 3-point area 36, the defensive goalie may deflect the ball when the ball is on the hoop 10. It is a violation if any player, including the goalie, touches the ball when it is on its downward arc motion during a shot attempt outside of the 3-point area 36 . Ultimately, the court judge determines if the shot attempt had a chance of reaching hoop 10.

The penalty for goal blocking violations is that the points are scored, and the defensive team receives a goalie restriction (2 possessions).

Double Defense violations

The defensive team must maintain man to man coverage. In other words, more than one defensive player cannot guard one offensive player. Defensive players can switch coverage on offensive players if an offensive player is attacking the hoop 10. The defensive team must regain man to man coverage within 2 seconds, counted by the court judge.

The penalty for double defense violation is a goalie restriction (four possessions).

Court Position Violations

As mentioned previously, each of the following players has restricted areas of play: 1) the runner and gunner remain outside of the 3-point shooting line 54; 2) the wingman and rim-man remain inside the 3-point line 54; 3) the goalie also remains inside the 3-point shooting line 54 of the defensive end of court; except in power play situations where there is a goalie restriction (refer to Game Definitions).

Players can only handle the ball and make shot attempts inside their restricted areas of play. On shot attempts, both feet must be completely within their restricted areas. Any player may handle the ball during a transition play (refer to Game Definitions), but shot limitations apply.

The penalty for a court position violation is a goalie restriction (six possessions).

Game Hold-Ups

A game hold-up is defined as any of the following: 1) keeping the ball from being immediately made live; 2) touching the ball while the thrower still has possession on a throw-in, or if any part of the defender's body extends over the court boundary line; 3) keeping the goalie from immediate access to the ball after a successful goal including blocking the goalie or deflecting the ball away from his reach; and 4) if a team prevents play from starting.

The first game hold-up violation penalty results in the opponent receiving three free-shots. If the offender had possession, the team offended will regain possession. The second and all subsequent game hold-up violations result in a goalie restriction (two possessions).

Running Substitutions

The following occurs in any player substitution: 1) substitute players have to replace the position of the player they are replacing; 2) the score judge releases the substitute to his running substitution box 62; 3) players report to the running substitution box 62 on their teams' defensive Goal; 4) players are to place both feet inside running substitution box 62 and wait until the player being replaced is completely inside the running substitution box 62; 5) the substitute's team must have possession of the ball to begin the substitution; 6) substitutions are made only during live play; and 7) teams are to maintain the proper number of players on the court at all times.

The penalty for Running Substitution violations is a goalie restriction (2 possessions).

Player Behavior

A court judge can assess a player behavior penalty for behavior deemed a hindrance to the progression of the game. Court judges can give player behavior violations to player (s), coach(es), and any member on a team's bench. This penalty can be given at anytime without prior warning.

A person who receives two player behavior penalties during the same game is automatically ejected from the playing arena. The behaviors that justify a player behavior penalty include, but are not limited to: 1) verbal disrespect of the court judges; 2) aggressive physical contact with a court judge; 3) unreasonable acts in disputing or disagreeing with a court judge call; 4) obscene language; 5) deliberate physical attacks toward another player, coach, or judge; and 6) excessive contact.

The penalty for the first player behavior violation is the ball is first awarded to the opponent plus a goalie restriction (4 possessions), and the player is assessed a clip. The penalty for the second player behavior violation is the player is ejected plus a goalie restriction (4 possessions). If the violation involves members from both teams (double player behavior penalty) then there is a face-off plus a goalie restriction for both teams (4 possessions), and each player involved is assessed with a clip. Still, there are various player behavior violations that warrant ejection from the game including punching (no contact is required), fighting or taunting that appears to urge an altercation, deliberate aggressive use of elbows making contact, and other circumstances not limited to these whereby the court judges think it is appropriate to eject a player. If the player is ejected before there is opportunity to complete the free shots, he must leave immediately and the head coach selects from the remaining players to shoot free shots.

Clip

A clip is any acts that impede the progress of an opponent, intentionally or unintentionally, by the use of arms, legs, knees, and pushing or grabbing. A player cannot grab, push, or straight-arm an opponent. They are not allowed to manipulate their legs to stop the attack of an offensive player, but they can initiate body contact with their torso, except in cases of blocking. Defensive players can make contact with the shooting hand of the offensive player if the offensive player's hand is still touching the ball. Additionally, if an offensive player is clipped while in the motion of a successful shot attempt, the goal will count, even if the shot was released after a clip was called.

Both offensive and defensive players have the right to any location on the court but not commit a court player position violation. The offensive player has the right to position his feet in any area when swiveling. The defensive player must yield this space to the offensive player's effort to reposition his feet. The defensive player may maintain spacing anywhere on the court by placing one hand or bent forearm on an offensive player. A player who causes illegal contact with another opponent will be charged with a clip.

A defensive player with a clip also receives a team clip. An offensive player charged with a clip receives a personal clip. In all situations the opponent is awarded: 1) the ball for a throw-in for an offensive clip; 2) the ball for a throw-in for a defensive clip, if under team clip limits; 3) one free shot attempt if the defender clips an offensive player during a successful shot attempt; 4) Two/Three free shots if the defender clips during an unsuccessful shot attempt; and 5) a goalie restriction (2 possessions) for every team clip that exceeds the limit.

Clip by Dribble

A player who is dribbling cannot run into a defender who has established their position on the court. The dribbler is assessed an offensive clip and the opponent is awarded a throw-in from the sideline. If a player who is dribbling is able to position their shoulders ahead of the defender, the responsibility of illegal contact is on the defender and the defender is assessed a personal clip. The defender's team is also assessed a team clip and the ball is awarded for a throw-in to the offensive team. If the penalty is active, than a goalie restriction takes place. Lastly, shot attempts cannot be scored on a clip if a dribble follows the clip.

Clip by Blocking

A player cannot initiate contact on a block from the side or from behind an opponent. However, a player can establish position near the side or backside of an opponent so that a teammate can "rub-off" (refer to Game Definitions) a defender. Also a player cannot establish a blocking position against another player that has already started moving toward the goal. Once a blocker has established a position behind or on the side for a rub-off, the blocker cannot move toward opponent.

The penalty for clip by blocking violation is award of the ball to the opponent for a throw-in, and the offensive clip is assessed to the offender.

Free Shot Opportunities

An offensive player clipped in the act of shooting receives free shot attempts. If the shot attempt is in the two-point area, then two free shot attempts are awarded. If the shot attempt is in the three-point area, then three free shot attempts are awarded.

A team on a successful two-point shot attempt can score a maximum of three points. Similarly, a team on a successful three-point shot attempt can score only four points.

Double-clip

If opponents clip each other, then each is assessed a clip and the ball is awarded to the team with possession prior to the violation; unless it is a player behavior violation. A double clip does not change time on the 17-second shot clock.

Offensive clip

If an offensive player is assessed with a clip, the penalty is the opponent receives a throw-in from the sideline and the successful goal counts; except in situations of a player behavior violation.

No Possession Clip

If a clip occurs while no team has possession of the ball, then the player is assessed a clip and the ball is awarded to opponents for a throw-in; except in situations of a player behavior violation.

Shortage of Eligible Players

When a team has fewer then six players eligible because of disqualification through clips or ejection, the last player disqualified re-enters the game. Under no circumstances can a player ejected from the game re-enter the game. When a player receives his seventh clip and his disqualification reduces the number of eligible players for his team to five, the player is then replaced by the player previously disqualified.

The penalty for a shortage of eligible player violation is the disqualified player is charged with a seventh clip, the team is charged with a team clip plus a goalie restriction (two possessions).

However, when a disqualified player commits a clip, the team is charged with a team clip. If the team is in penalty, penalty applies plus a goalie restriction (2 possessions) is given to the opponents, in addition to the other penalties.

Game Definitions

3 Point-key

The area of court under the hoop 10, that measures 20 feet in width by 17 feet 4 inches in length. All successful goals within the 3- point area are three points.

2 Point-lane

The area of court between the 3-point shooting line and the 3-point area. All goals made within the 2-point lane are two points.

Running Substitution

The subject game player replacement method. Player substitutions take place during a team transition from defense to offense.

Face-off

An equal opportunity for opponents to gain possession of the ball at the beginning of each period. Two players face each other while a court judge bounces the ball off the court into the air. Players pursue the ball to gain possession.

Transition Play

A transition Play is when the offensive team aggressively moves the ball toward their hoop 10 immediately upon gaining possession. A transition play ends when forward progress is pausing or stopped for two counts (seconds). However, the ball may be passed to a position parallel from where the pass is initiated. When the ball is passed in the opposite direction of the offensive hoop 10, the transition play ends.

Rub-off

A rub-off occurs when an offensive player uses a teammate to create space between himself and his defender. The offensive player attempts to run his defender into is a teammate.

Dribble

Dribbling is bouncing the ball with either hand. Dribbling is completed when: 1) a player touches the ball simultaneously with both hands; 2) permits the ball to stop bouncing while he is in control of it; 3) tries for a shot attempt; 4) throws a pass; 5) touches the ball more than once during a bounce and before it touches the floor; and 6) loses control of the ball.

Free Shot

A free shot attempt is the opportunity to score one point with no opponent interference. The shot attempt is made from behind the penalty shot line. Players have 5-seconds to make the free shot Attempt.

Front Court/Back Court

A team's front court is the area between the mid-court line and the end line of their offensive goal. A team's back court is the court between the mid-court line and the end line of their opponent's goal. The ball can be moved between the front court and back court by the offensive team without generating a violation.

Tie-up

A tie-up is when two opponents have one or both hands firmly on the ball, and both are struggling for possession.

Swivel

A Swivel occurs when the player who is in control of the ball steps once or more in any direction with the same foot, without lifting the other foot from the floor. To dribble from the swivel, a player must release the ball from his hands before he lifts his swivel foot from the floor; or he must pass or shoot if he raises his swivel foot. It is a roaming violation if the does not.

Roaming

Roaming is moving in any direction with control of the ball, without dribbling, that exceeds three steps.

Block

A Block is allowed for players who, without causing excessive contact, delay or prevent an opponent without the ball from moving through or by them. The following rules apply in a block: 1) a player's arms and elbows are at an angle less than 45-degrees and his hands must remain closed; except when covering his groin area during a block; 2) players must have their shoulders squared and facing the opponent before a block is initiated; except if a teammate is running an opponent off of a stationary block, or rub-off; and 3) a player may drive his feet once contact is made, but can only move forward while maintaining a shoulder to shoulder alignment with his opponent; if shoulders are no longer aligned, the block must be released; and 4) a defensive player cannot use his hands to break free of a block, and his arms are at an angle less than 90-degrees in his attempt to free up.

Shot Attempt

Shot Attempts occur when a player attempts to make a basket, including the moment he begins the motion of an attempt until the moment he returns to his normal position. The movement of the ball toward the basket is considered part of the Shot Attempt until another player touches the ball.

Throw-In

The throw-in is the method of starting play from outside the court boundaries. The throw-in begins when the ball is in possession of the team entitled to it, and end with the release of the ball by the thrower.

Free Shot Protection

Protection provided for players taking a free shot. Opponents are not allowed to lift their arms above their shoulders, make sudden movements or loud noise toward the shooter, his teammates, or his team's bench.

Goalie Restriction

A goalie restriction is awarded as a result of a penalty from the opposing team. The goalie is removed from live play and stationed in a penalty box positioned outside the court. The goalie must remain in the penalty box for the duration of the penalty. A goalie restriction is measured in the number of offensive possessions. On the first possession, the opponent receives the ball for a throw-in, this counts for one possession. Each time the opponent loses control of the ball through scoring or a turnover and regains the control of the ball, a new possession will begin.

Power Play

When a team is charged with a goalie restriction penalty, its opponent's goalie has unlimited mobility on the playing field.

Three-On-Three Game

Figure 5:
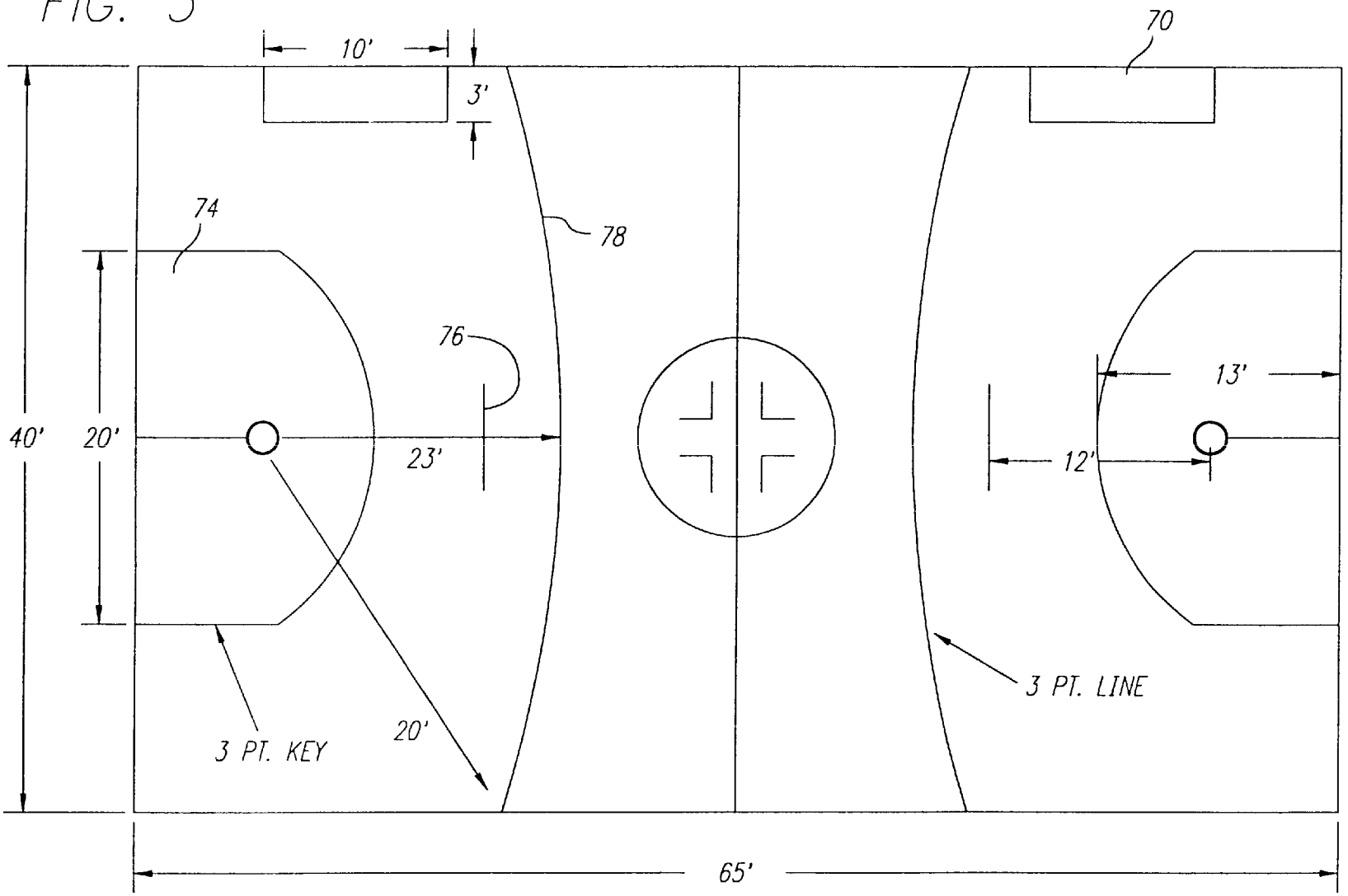
FIG. 5 is a top view of an alternate court design having different dimensions and played by fewer players than the first embodiment.

FIG. 5 shows the layout of an alternative embodiment of this invention. First, the court dimensions are substantially smaller than in the first embodiment, indeed smaller than a traditional basketball court. The court is 65 feet in length, 40 feet in width and has 10 feet by 3 feet running substitution boxes 70. The 3 point area or key 74 is 13 feet by 20 feet and the free shot line 76 is 12 feet from the center of the hoop. The 3-point line 78 ranges from 20 from the end of the court to 23 feet at its furthest point.

Play is by three players on each side, a gunner, a slasher, and a rim-man, each having the same "territory" as in the first embodiment. All other aspects are the same as in the first embodiment, mutatis mutandis.

What is claimed is:

1. A basketball-like game to be played with a basketball by two competing teams of players, comprising:

a playing field having a goal region at two opposite ends:

a goal defined by a hoop disposed over each goal region of the playing court;

a three point area demarcated on the playing field beneath each hoop; and a three point line spaced outwardly from the demarcated three point area, toward but not reaching the center of the playing field, defining a two point lane between the three point line and the demarcated three point area.

2. The game of claim 1 in which said three point line is partially circular and the area outward of the partially circular line is a three point area.

3. The game of claim 1 including two demarcated substitute boxes on a side of the court to allow running substitution of players.

4. The game of claim 1 including a demarcated face off area in the center of the court.

5. The game of claim 1 wherein said demarcated face off area is has markings therein directing the standing position of players.

6. The game of claim 1 in which the hoop has an opening for the basketball that is less than 17 inches.

7. The game of claim 6 in which said hoop opening is 16 inches.

8. The game of claim 1 in which said hoop is located above the court at a height of at least 10 feet and 3 inches.

9. The game of claim 8 in which the height of said hoop above the court is 10 feet and 6 inches.

10. The game of claim 1 in which there is no hoop backboard.

11. A method of playing a game comprising the steps of:

providing a playing field having a first end goal and a second end goal on opposite ends of the playing field, each having a hoop disposed thereover defining the scoring area for that goal;

providing a basketball;

providing a three point area demarcated on the playing field beneath each hoop; and providing a three point line spaced outwardly from the demarcated three point area, toward the opposite end goal, defining a two point lane between the three point line and the demarcated three point area; and providing first and second teams of players alternately playing offense and defense and having as objectives (i) offensively to move the ball into the defenders' goal whereby movement of said ball is accomplished by a player optionally dribbling with said ball, passing said ball to another player, and/or shooting said ball through the goal hoop, and (ii) defensively stopping movement of the ball by the offensive team toward the defenders' goal by blocking a player of said offensive team who is in possession of the ball, acquiring possession of the ball from the offensive team, disrupting a pass between players on the offensive team and/or disrupting an attempt by a player on the offensive team to shoot the through the goal.

12. The method of playing a game of claim 11 including a rule of play wherein a player may be substituted only while the shot clock is running.

13. The method of playing a game of claim 11 in which there are six active players on each team.

14. The method of playing a game of claim 13 in which one of said players is a goalie whose position diring normal active play is restricted to said demarcated three point area.

15. The method of playing a game of claim 14 including a rule of play wherein said goalie may not be guarded by a defensive player.

16. The method of playing a game of claim 13 in which two of said players are restricted to active play outside the 3-point line and are limited to taking shot attempts from that range.

17. The method of playing a game of claim 13 in which two of said players are restricted to shooting from within the 3-point line.

18. The method of playing a game of claim 13 in which one of said players has unrestricted movements, and can play and take shots from anywhere on the court.

19. The method of playing a game of claim 11 including a rule of play wherein when a player is physically outside of the boundaries of the playing field, the ball continues to be in play if the ball is being dribbled inside said boundaries.

20. Combined apparatus for playing a basketball-like game, comprising:

a basketball;

a playing field having a goal region at two opposite ends:

a goal defined by a hoop disposed over each goal region of the playing court;

a three point area demarcated on the playing field beneath each hoop; and a three point line spaced outwardly from the demarcated three point area, toward but not reaching the center of the playing field, defining a two point lane between the three point line and the demarcated three point area.

21. The apparatus of claim 20 in which said three point line is partially circular and the area outward of the partially circular line is a three point area, and including two demarcated substitution boxes on a side of the court, and a demarcated face off area in the center of the court.

22. The apparatus of claim 20 in which said hoop has a 16 inch opening and is located 10 feet and 6 inches above the court.

23. The apparatus of claim 20 in which there is no hoop backboard.

24. A method of playing a game comprising the steps of:

providing a playing field having a first end goal and a second end goal on opposite ends of the playing field, each having a hoop disposed thereover defining the scoring area for that goal;

providing a basketball;

providing a three point area demarcated on the playing field beneath each hoop; and providing a three point line spaced outwardly from the demarcated three point area, toward but not reaching the center of the playing field, defining a two point lane between the three point line and the demarcated three point area;

providing first and second teams of players alternately playing offense and defense and having as objectives (i) offensively to move the ball into the defenders' goal whereby movement of said ball is accomplished by a player optionally dribbling with said ball, passing said ball to another player, and/or shooting said ball through the goal hoop, and (ii) defensively stopping movement of the ball by the offensive team toward the defenders' goal by blocking a player of said offensive team who is in possession of the ball, acquiring possession of the ball from the offensive team, disrupting a pass between players on the offensive team and/or disrupting an attempt by a player on the offensive team to shoot the through the goal;

wherein the players of offensive and defensive teams have restricted areas of play in which:

(a) a goalie has liberties and protection in the demarcated 3-point area, said liberties including being able to deflect the ball on its downward arc towards said goal, and being able to move the ball without dribbling inside the 3-point area, said protection including freedom from being guarded, (b) two of said players are restricted to active play outside the 3-point line and are limited to taking shot attempts from that range, (c) two of said players are restricted to shooting from the 2-point lane, and (d) one of said players has unrestricted movements, and can play and take shots from anywhere on the court.

* * * * *